US007401629B2

(12) United States Patent
Zhou

(10) Patent No.: US 7,401,629 B2
(45) Date of Patent: Jul. 22, 2008

(54) MOUNTING APPARATUS WITH THREE THROUGH HOLES

(75) Inventor: Qidi Zhou, Zhejiang Province (CN)

(73) Assignee: QIDI Electric Group, Cixi (CN)

( * ) Notice: Subject to any disclaimer, the term of this patent is extended or adjusted under 35 U.S.C. 154(b) by 123 days.

(21) Appl. No.: 11/455,654

(22) Filed: Jun. 20, 2006

(65) Prior Publication Data

US 2007/0289666 A1 Dec. 20, 2007

(51) Int. Cl.
*B65B 1/04* (2006.01)

(52) U.S. Cl. ..... 141/365; 141/297; 141/300; 141/330; 141/348

(58) Field of Classification Search ..... 141/285, 141/286, 288–301, 308, 319–322, 329–332, 141/346–366; 222/83.5, 325, 146.6, 146.1
See application file for complete search history.

(56) References Cited

U.S. PATENT DOCUMENTS 5,647,416 A * 7/1997 Desrosiers et al. ..... 141/351
6,193,113 B1 * 2/2001 Hidding ..... 222/325
6,619,511 B2 * 9/2003 Hydak et al. ..... 222/185.1

* cited by examiner

*Primary Examiner*—Timothy L Maust
(74) *Attorney, Agent, or Firm*—Pillsbury Winthrop Shaw Pittman LLP

(57) ABSTRACT

The present invention relates to a mounting apparatus with three through holes, which is provided with a top wall, a bottom wall, an inverted annular body extending downwardly and inwardly connecting the top wall to the bottom wall, a cavity enclosed by the annular body, and a post defined in the cavity, wherein the post extends from the bottom wall into the cavity, with through holes defined in the bottom wall and guiding grooves defined on the post, in which the guiding grooves extend from a free end of the post to a bottom end thereof and are correspondingly formed with respect to the through holes. The mounting apparatus with three through holes is advantageous in that it integrates conventional feed probe and mounting apparatus so that the integrated structure is simplified, and its components are more effectively assembled at a relatively lower cost. Meanwhile, vents provided on the outer side of the top wall define a clear air passage for the water dispensing system.

9 Claims, 3 Drawing Sheets

MOUNTING APPARATUS WITH THREE THROUGH HOLES

TECHNICAL FIELD

The present invention relates to a mounting apparatus with three through-holes, and more particularly, to a mounting apparatus with three through-holes used in a water dispenser for bottled water for dispensing drinking water and other potable liquid from an inverted liquid container into a water reservoir of the dispenser.

BACKGROUND

Water dispensing system is commonly used in water dispensers for bottled water. Its main function is to: forcibly insert through a cap of a inverted liquid container to permit the discharge of drinking water from a water tank until a predetermined water level is achieved; to partially support the weight of the water container; and to guide clean air above the water reservoir into the water container as to fill the space previously occupied by the discharged water. However, the conventional dispensing system for water dispensers for bottled water commercially available are usually complexly configured and comprise a number of accessory parts, such as a probe, a mounting apparatus, etc. Each of these parts should be precisely assembled in perfect relation with others; therefore result in both complexity and relatively higher cost in the manufacturing process. The mounting apparatus must be mounted onto the top of a water dispenser for bottled water, probe must be must be secured by an outer base, which must be fixed into mounting apparatus, and finally all of which working together to create a dispensing system Therefore, there exists a need to provide a simplified dispensing system for water dispensers for bottled water.

SUMMARY OF THE INVENTION

An objective of the present invention is to provide a mounting apparatus with three through holes, which is both simple and cost effective.

Above objective is achieved through a mounting apparatus with three through holes, which is provided with a top wall, a bottom wall, an inverted annular body extending downwardly and inwardly connecting the top wall to the bottom wall, a cavity enclosed by the annular body, and a post defined in the cavity, wherein the post extends from the bottom wall into the cavity, with through holes defined in the bottom wall and guiding grooves defined on the post, in which the guiding grooves extend from a free end of the post to a bottom end thereof and are correspondingly formed with respect to the through holes.

Preferably, the top wall is provided with a vertical periphery axially extending from the top wall, in which the vertical periphery cooperates with upper cover element(s) of the water dispenser for bottled water.

Preferably, vents enabling a clear air passage for the water dispensing system are situated along the outer circumference of the top wall.

Preferably, at least two clipping hooks clamping against the upper cover element(s) of the water dispenser for bottled water are uniformly provided along the vertical periphery.

Preferably, retainer legs clamping against the upper cover element(s) of the water dispenser for bottled water are provided in the inner wall of the vertical periphery.

Preferably, the post is provided with three equally spaced protuberant ribs, in which the guiding grooves are defined between neighboring ribs.

Preferably, the free top end of the post in the cavity is a conical end.

Preferably, the through holes are crescent shaped.

The water dispensing device according to the present invention is advantageous in that a mounting apparatus with three through holes of the invention integrates a conventional probe and mounting apparatus together so that the integrated structure may be greatly simplified, and its components are more effectively assembled at a relatively lower cost, reliability of the water dispensing system may be improved. The top wall and the conical, inverted annular body can both serve as support surface to hold the water container. The vertical periphery and retainer legs and clipping hooks defined thereon may cooperate with upper cover element(s) of the water dispenser for bottled water so that the mounting apparatus may be easily loaded onto or disengaged from the water dispenser for bottled water with a simple clockwise or counter-clockwise turn, and therefore ensure great flexibility in assembly and repair. The top of the post of the mounting apparatus is conical, such that it ensures easy forcible insertion through a cap of the water container. Three curved guiding grooves in axial direction are defined along the post so that drinking water in the container may flow down smoothly towards the bottom thereof. The hollow structure of the post may increase the strength of the post and improve the appearance thereof. Meanwhile, vents provided on a back-side of the top wall define a clear air passage for the water dispensing system.

DETAILED DESCRIPTION

Figure 1:
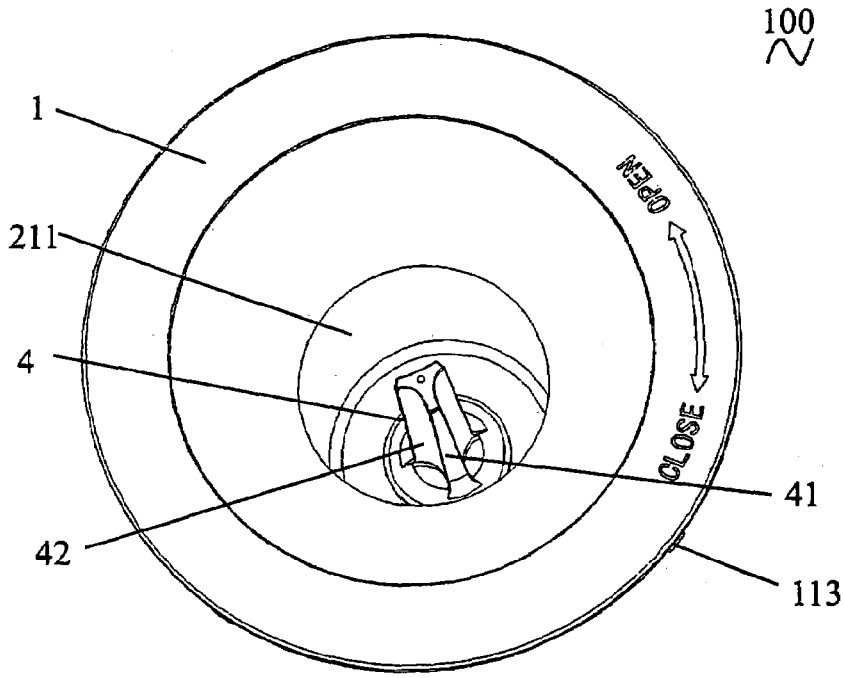
FIG. 1 illustrates a perspective view of a mounting apparatus with three through-holes according to the present invention.
Figure 2:
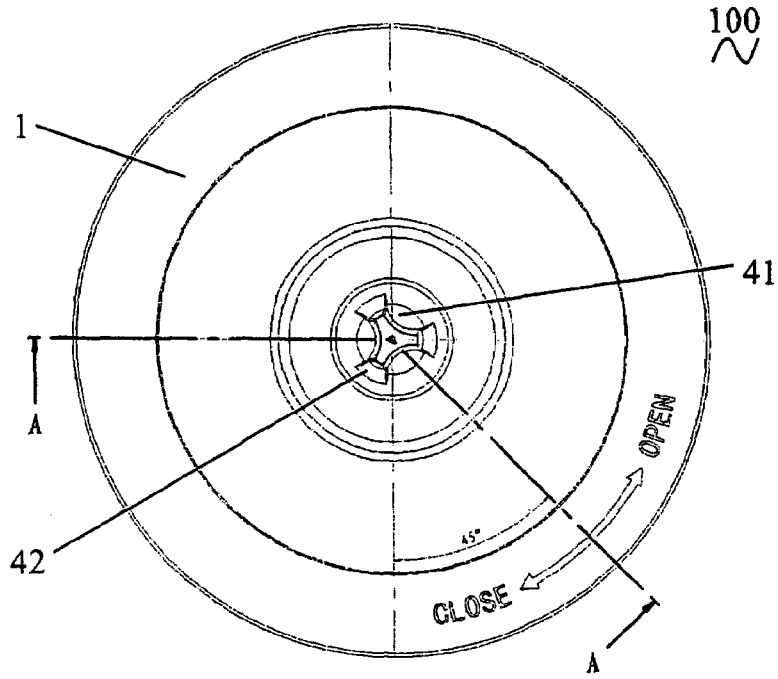
FIG. 2 is a plan view of FIG. 1.

Referring to FIGS. 1 and 2, a mounting apparatus 100 with three through-holes according to the present invention is provided with a top wall 1, a bottom wall 3, an inverted annular body 2 extending downwardly and inwardly connecting the top wall 1 to the bottom wall 3, and a post 4 protruding from the center of the bottom wall 3 towards the top wall 1.

Figure 4:
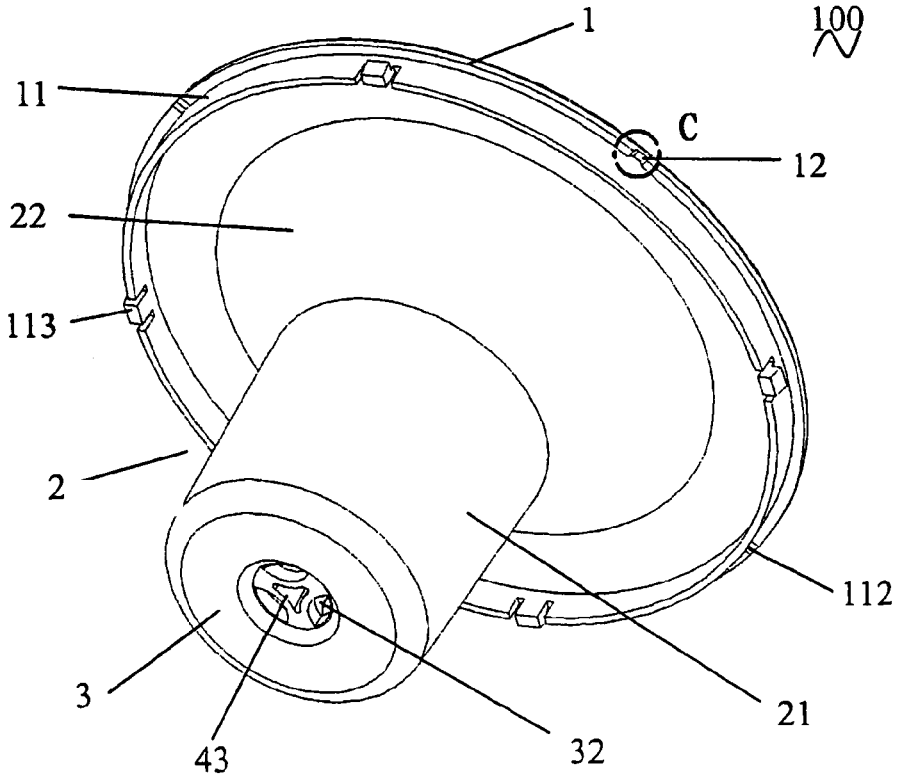
FIG. 4 is another perspective view of the mounting apparatus from a different view angle.
Figure 5:
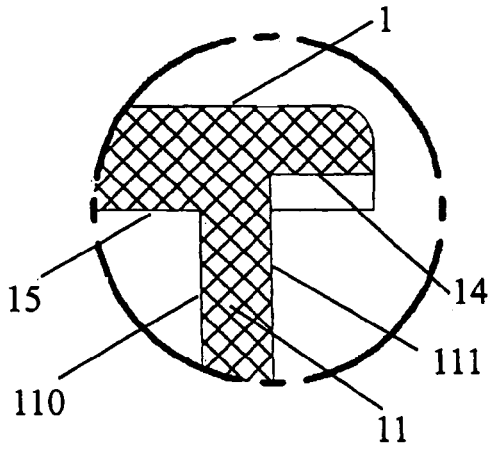
FIG. 5 is a partially enlarged view of a part B in FIG. 3.
Figure 6:
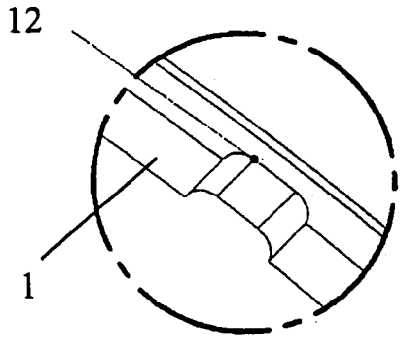
FIG. 6 is a partially enlarged view of a part C in FIG. 4.

Said top wall 1 is substantially annular, and comprises a vertical periphery 11, which is close to the outer circumference of the top wall 1 and extends towards the top wall 1 along an axial direction, and vents 12 situated along the outer circumference of the top wall (FIG. 6), and retainer legs 112 and clipping hooks 113 uniformly provided along the vertical periphery 11 of the top wall 1. Referring to FIGS. 4 and 5, a free end (not identified) of the clipping hook 113 extends outwardly from the outer wall 111 of the periphery 11, while a retainer leg 112 is provided on the inner wall 110 of the vertical periphery 11. Meanwhile, the thickness of the top wall 1 is greater at the side of the inner wall 110 of the vertical periphery 11 than the thickness at the side of the outer wall 111 of the vertical periphery 11.

Figure 3:
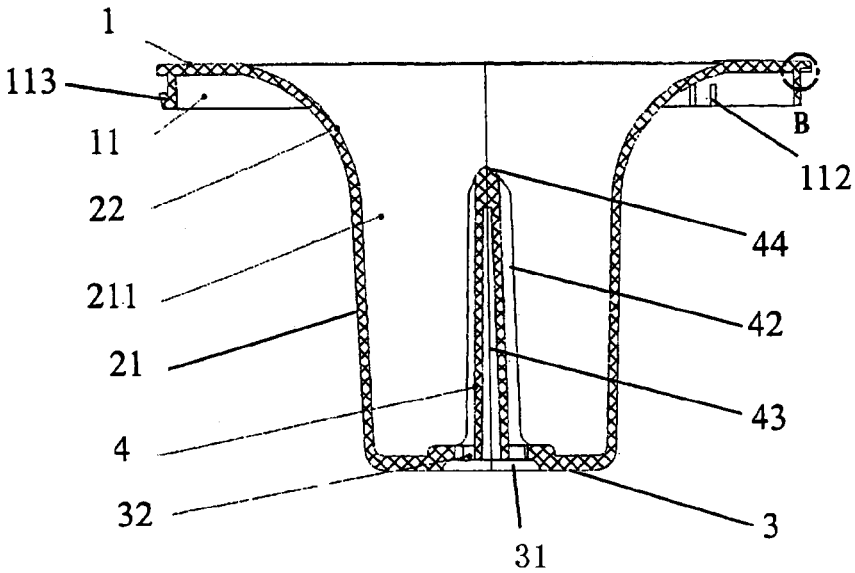
FIG. 3 is a cross-section view along the line A-A in FIG. 2.
Figure 7:
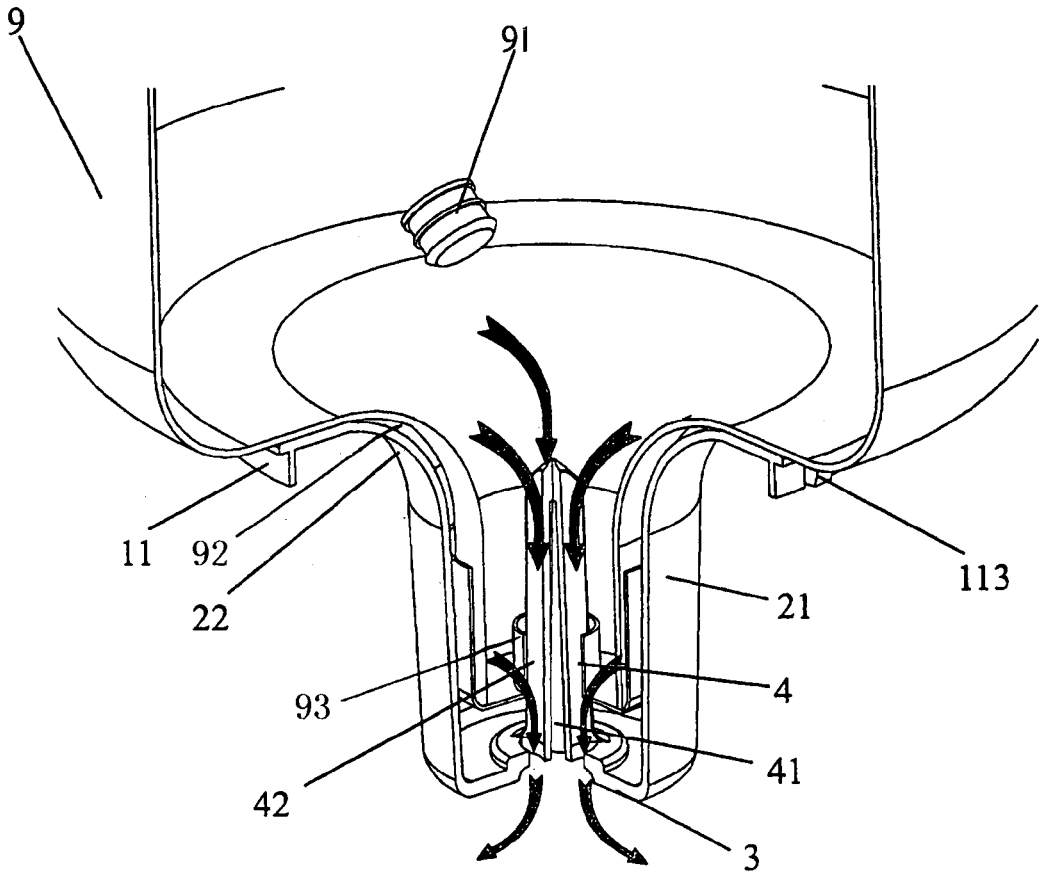
FIG. 7 illustrates a flow sketch obtained when the present invention is applied to a water dispenser for bottled water.

Referring to FIGS. 3 and 4, the inverted annular body 2 comprises a cylindrical wall 21, and a conical wall 22 extending upwardly from the cylindrical wall 21 in an enlarged manner. The shape of said conical wall 22 is similar to that of a trumpet. As shown in FIG. 7, the inverted annular body 2 and the top wall 1 both serve as supporting base to shoulder an inverted drinking water container 9. The bottom wall 3 is provided at the bottom of the cylindrical wall 21 of the inverted annular body 2. A bottom groove 31 is provided about the center of the bottom wall 3, with through holes 32, which are substantially crescent-shaped, evenly distributed in the bottom groove 31. The inverted annular body 2 and the bottom wall 3 enclose a cavity 211 therein. As shown in FIG. 7, the cavity 211 may hold a neck 92 of the drinking water container 9.

Referring to FIG. 1 to 3, the post 4 extends upwardly from the bottom of the groove 31 of the bottom wall 3 to inside of the cavity 211. The post 4 comprises three protuberant ribs 41 which are evenly distributed about the center of the post, and guiding grooves 42 between two ribs 41, wherein the outline of a protuberant rib 41 is curved and the cross-section of a guiding groove 42 is substantially arc-shaped. Preferably, the cross-section of a guiding groove 42 is similar to or the same as that of a crescent through hole 32. Meanwhile, the guiding grooves 42 extend downwardly from the top of the post 4 till the through holes 32. A cavity 43 extending axially from the bottom side where the post 4 connects to the bottom wall 3 towards the top of the post 4 is provided. The top 44 of the post 4, which is a free end in the cavity 211, is conical-shaped. The cavity 43 may increase the rigidity of the post and improve the appearance thereof. And the conical top 44 facilitates to poke a cap 91 of the drinking water container 9 through (FIG. 7).

Referring to FIG. 1 to 7, when a mounting apparatus 100 with three through-holes according to the present invention is loaded on a water dispenser for bottled water (not shown), the vertical periphery 11 of the top wall 1 cooperates with upper cover element(s) of the water dispenser for bottled water. After the mounting apparatus 100 is turned 45° conversely (along the CLOSE arrow as shown in FIG. 2), four clipping hooks 113 provided along the vertical periphery 11 tightly clamp against upper cover element(s) of the water dispenser for bottled water, and the retainer legs 112 also helps to secure the water container to the mounting apparatus. The top wall 1, inverted annular body 2 and upper cover element(s) of the water dispenser for bottled water work together to support the drinking water container 9, wherein the neck 92 of the container 9 is correspondingly inserted into the inverted annular body 2 so that the container 9 is well supported. When the drinking water container 9 is inserted into the mounting apparatus 100, the cap 91 of the container 9 may be appropriately penetrated through since the outer diameter of the post 4 is equal to the diameter of the cap 91, and that the height of the post 4 in the axial direction is larger than that of the neck portion of the inverted water container 93. After the cap 91 has been probed through by the top 44 of the post 4, drinking water in the container 9 flows along three curved guiding grooves 42, with a 120° angular interval therebetween, of the post 4 to the three crescent-shaped through-holes 32 and from there to a water reservoir (not shown) below the bottom wall 3 till a predetermined water level is achieved. A clear air passage for a water dispensing system is formed by vents 12 provided along the outer circumference of the top wall 1, and clean air above the water reservoir may travel through these vents 12 to the interior of the container 9 so as to fill the space previously occupied by those discharged water. When dismounting is required, the said mounting apparatus 100 may be simply turned in the open direction (OPEN arrow shown in FIG. 2) so that the favorable locking between the mounting apparatus 100 and the water dispenser for bottled water may be released and the mounting apparatus 100 may be disengaged from the water dispenser for bottled water.

It should be noted that the cross-section of a guiding groove 42 may be curved, parabolic, triangular, etc. The outline of the through holes 32 may also be differently shaped. The mounting apparatus 100 with three through-holes according to the present invention may also be applied to other similar equipments except water dispensers for bottled water.

The mounting apparatus 100 with three through-holes according to the present invention is provided with an integral structure. Therefore, its structure is simplified, the reliability of the water dispensing system is improved, and the strength for part of the mounting apparatus is increased.

Although a preferred embodiment of the present invention has been disclosed for illustrative purpose, it should be noted any revision and/or modifications to the application of this invention is considered an extended application of the present invention defined in above claims and therefore protected under this patent.

What is claimed is:

1. A mounting apparatus with three through holes, comprising:

a top wall;

a bottom wall containing the three through holes;

an inverted annular body extending downwardly and inwardly connecting the top wall to the bottom wall;

a cavity enclosed by the annular body;

a post defined in the cavity, the post extending from the bottom wall into the cavity, and a top of a free end of the post being conically shaped;

guiding grooves formed on the post, the guiding grooves extending from the free end of the post to a bottom end thereof;

a plurality of fastener members formed on the top wall adapted to secure the mounting apparatus to a water dispenser;

wherein the guiding grooves are aligned with the through holes such that the cross-section of a guiding groove is similar to or the same as that of the through hole.

2. A mounting apparatus with three through holes according to claim 1, wherein the top wall is provided with a vertical periphery axially extending from the top wall, in which the vertical periphery is adapted to engage with upper cover element(s) of the water dispenser for bottled water.

3. A mounting apparatus with three through holes according to claim 2, wherein vents enabling clear air passage for the water dispensing system are evenly situated on the outer circumference of the top wall.

4. A mounting apparatus with three through holes according to claim 2, wherein the plurality of fastener members include at least two clipping hooks evenly provided along the vertical periphery for snap-fitting the upper cover element(s) of the water dispenser for bottled.

5. A mounting apparatus with three through holes according to claim 2, wherein the plurality of fastener members include retainer legs provided on the inner wall of the vertical periphery for snap fitting the upper cover element(s) of the water dispenser for bottled water.

6. A mounting apparatus with three through holes according to claim 1, wherein the post is provided with three equally-spaced protuberant ribs, wherein the guiding grooves are defined between neighboring ribs.

7. A mounting apparatus with three through holes according to claim 1, wherein the through holes are crescent-shaped.

8. A mounting apparatus with three through holes according to claim 1, wherein the cross-section of the guiding groove is arc-shaped, curved, parabolic, or triangular.

9. A mounting apparatus with three through holes according to claim 5, wherein the mounting apparatus is configured to rotate between a lock position, where the plurality of fastener members secure the mounting apparatus to the water dispenser and an unlock position, where the plurality of fastener members are released from the water dispenser to disengage the mounting apparatus from the water dispenser for bottled water.

* * * * *